United States Patent [19]

Husa

[11] 4,253,478

[45] Mar. 3, 1981

[54] FOLDING CRUTCH

[76] Inventor: Emmett O. Husa, 12739 Phinney Ave. N., Seattle, Wash. 98133

[21] Appl. No.: 60,646

[22] Filed: Jul. 25, 1979

[51] Int. Cl.[3] ..... A61H 3/02

[52] U.S. Cl. ..... 135/68; 135/74

[58] Field of Search ..... 135/68, 74

[56] References Cited

U.S. PATENT DOCUMENTS

| | | | |
|---|---|---|---|
| 39,854 | 9/1803 | Wemple | 135/68 |
| 595,637 | 12/1897 | Kuhnke | 135/68 |
| 1,068,564 | 7/1913 | Carrington et al. | 135/74 |
| 1,334,208 | 3/1920 | Ames | 135/68 |
| 2,484,406 | 10/1949 | Gibson | 135/68 |
| 2,707,477 | 5/1955 | Chapin | 136/68 |
| 3,239,255 | 3/1966 | Murcott . | |
| 3,492,999 | 2/1970 | Boyd | 135/68 |
| 3,655,297 | 4/1972 | Bolen et al. | 135/74 |
| 3,886,962 | 6/1975 | Diamontis | 135/74 X |

FOREIGN PATENT DOCUMENTS

| | | | |
|---|---|---|---|
| 126298 | 1/1932 | Austria | 135/68 |

*Primary Examiner*—J. Karl Bell

*Attorney, Agent, or Firm*—Delbert J. Barnard

[57] ABSTRACT

A folding connector mechanism is housed within a single stile which is divided into major and minor parts. The major part constitutes the lower section of the crutch and the minor part is a portion of the upper section of the crutch. When the crutch is in its use position the weight of the user is transmitted by the folding connector mechanism directly from the lower end of the minor part of such stile to the upper end of the major part of such stile and is not carried by any cross pins or the like. The folding connector mechanism includes a lock button for locking the two sections of the crutch together when the crutch is in its use position. The lock button is positioned closely adjacent the handle of the crutch so that the user can grasp the handle with the thumb of such hand on the lock button while grasping the lower section of the crutch with his other hand. He then depresses the button while pulling the two sections of the crutch apart. This moves the folding connector mechanism out from a housed position, permitting its operation for folding the crutch.

6 Claims, 7 Drawing Figures

14
16
24
22
36
54
32
42
40
34

32
54
58
52
50
56
48
44
46
70
76
80
66
64
78
82
74
42
40
34

FOLDING CRUTCH

Technical Field

This invention relates to crutches and more particularly to the provision of an improved folding crutch.

Background Art

The idea of a folding crutch is not new. Examples of folding crutches which can be found in the patent literature are disclosed by the following U.S. Pats: No. 2,484,406, granted Oct. 11, 1949, to Henry L. Gibson, Sr; No. 3,492,999, granted Feb. 3, 1970, to Zann R. Boyd, and No. 3,886,962, granted June 3, 1975, to Damon Diamontis.

The main object of the present invention is to provide an improved folding crutch which is simple in construction yet which is strong and durable and capable of being easily moved between its use and folded positions.

SUMMARY OF THE INVENTION

A folding crutch of the present invention is basically characterized by upper and lower sections and connector means connecting the upper and lower sections together in a manner permitting said sections to be pivotally moved between an use position in which the upper and lower sections are generally aligned and a folded position in which each section is adjacent the other section. The upper section may comprise first and second spaced apart stiles, an underarm rest interconnected between the upper ends of said stiles, a handle interconnected between the stiles below said underarm rest, and a tubular upper or minor portion of a third stile connected to the lower ends of said first and second stiles. The lower section comprises a lower or major portion of the third stile. The connector means comprises a first end piece which is connected to the upper end of the lower portion of the third stile, a second piece which is telescopically received within the tubular upper portion of the third stile, and a link positioned between the first and second end pieces. The ends of the link are connected to the end pieces by pivot pin means in a manner permitting the end pieces, and the upper and lower sections of the crutches connected thereto, to be pivotally moved between a first position in which they are axially aligned with the link and a second position in which they are both substantially perpendicular to the link and adjacent one other. The connector means includes stops means for preventing telescopic movement of the second end piece completely out from the tubular upper portion of the third stile and releasable lock means carried by the second end piece which is engagable with the tubular upper section of the third stile for locking the two sections together when the crutch is in its use position.

According to an aspect of the invention, the upper end portion of the second end piece is hollow and includes a side wall and a first side wall opening therein. A spring means is located within the hollow interior of such second end piece. A lock button in registery with the side wall opening is biased radially outwardly by the spring means. The tubular upper portion of the third stile includes a second side wall opening which is in registery with the first side wall opening when the crutch is in its use position. When in such position the spring means serves to urge the lock button radially outwardly so that it extends through both side wall openings and projects outwardly beyond the side boundary of the tubular upper portion of the third stile, to lock the crutch in its use position. The lock button is depressible back into the hollow interior of the second end piece, to enable outward telescopic movement of such end piece when it is desired to fold the crutch.

According to another and quite important aspect of the invention, the side wall opening in the upper portion of the third stile may be spaced away from the handle a distance which makes it possible for a user to grasp the handle with one hand and place his thumb on the button. The other hand is used to grasp the lower section of the crutch. The user then depresses the button with his thumb while at the same time pulling the two sections of the crutch apart. This pulls the connector means out from its housing and permits its operation to fold the crutch. When it is desired to move the crutch back into its use position, the two sections of the crutch are merely swung back into longitudinal alignment and moved longitudially together. The connector means moves telescopically back into its housing until the lock button snaps back through the two aligned side wall openings.

According to another aspect of the invention, the weight of the user is transmitted by the connector means from the lower end of the tubular upper portion of third stile directly to the upper end of the lower portion of the third stile. No portion of this weight carried by hinge pins, lock pins or the like. This is a quite important feature and adds considerably to the life of the crutch.

Additional features, objects and advantages of the folding crutch of the present invention are described below in the description of the preferred embodiment.

BRIEF DESCRIPTION OF DRAWING FIGURES

BEST MODE OF THE INVENTION

Figures 1, 2, 3, 4, 5:
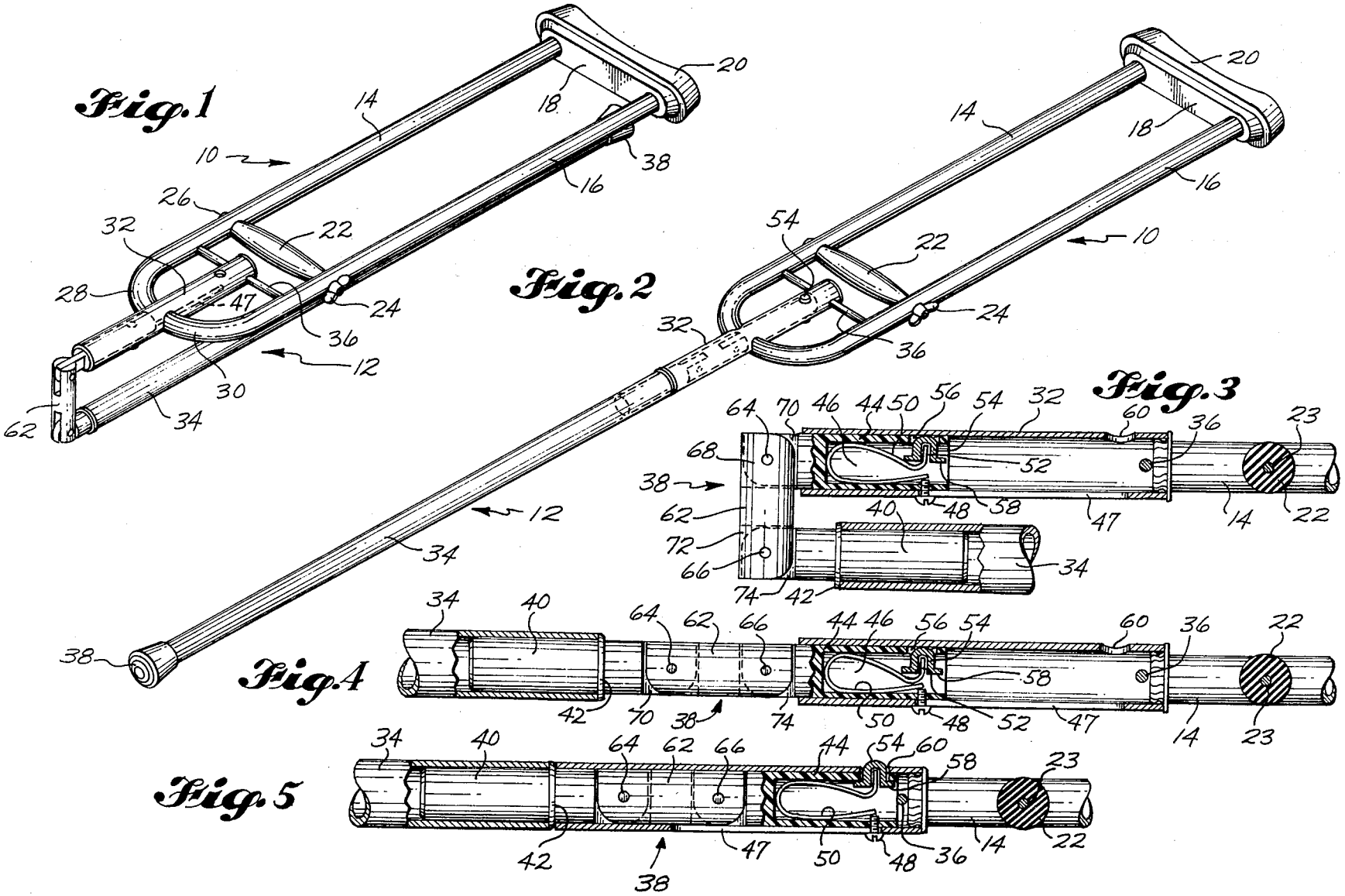
FIG. 1 is an isometric view of a folding crutch constructed according to present invention shown in its folded position.
FIG. 2 is an isometric view of the crutch in its use position.
FIG. 3 is an enlarged scale fragmentary view of the connector means between the two sections of the crutch, with some parts shown in side elevation and other parts shown in longitudinal section, with the components of the connector means being shown in the position which they occupy when the crutch is folded.
FIG. 4 is a view similar to FIG. 3, but showing the components of the connector means aligned preparatory to movement of the crutch into its use position.
FIG. 5 is a view like FIGS. 3 and 4, but showing the components of the connector means in the position in which they occupy when the crutch is in its use position.

Preferring first to FIGS. 1 and 2, the particular folding crutch which is illustrated, and which presently constitutes the best mode of the invention known to me, comprises an upper section 10 and a lower section 12. Preferably, but not necessarily, the sections 10, 12 are approximately equal in length so that the folded length of the crutch is at a minimum.

The upper section 10 may comprise first and second spaced apart stiles 14, 16, connected together at their upper ends by an underarm rest 18. The underarm rest 18 may be constructed from wood or plastic, and may be provided with a foam rubber or foam plastic pad 20. A handle 22 is interconnected between the stiles 14, 16 at an appropriate location below the underarm rest 18. The handle body may be constructed from wood or plastic and may be secured to the stiles 14, 16 by means of a bolt 23 which extends lengthwise through the handle 22 and through opposed openings formed in the stiles 14, 16. The bolt 23 may be secured in place by means of a nut 24 which in the usual manner threads onto the threaded end of the bolt 23 opposite its head 26. A wind nut 24 is illustrated. However, a flush head nut is preferred, but any suitable type of nut may be used.

The lower end portions 28, 30 of the stiles 14, 16 curve inwardly and join with an intermediate portion of a short tubular member 32 which constitutes an upper or minor portion of a third stile 34. The upper section 10 may include a cross brace 36 extending between the stiles 14, 16 and passing through openings formed in the upper end of tubular member 32.

The lower or major portion 34 of the third stile and a ground engaging pad or "tip" 38 at the lower end thereof together constitute the lower section 12 of the crutch.

As best shown by FIGS. 3–5 and 7, the upper and lower crutch sections 10, 12 are interconnected by a folding joint mechanism 38. This mechanism or connector means 38 serves to connect the upper and lower sections 10, 12 together in a manner said sections 10, 12 to be moved between a use position in which the upper and lower sections are generally aligned and a folding position in which section is adjacent the other section.

Connector means 38 comprises a first end piece 40 which is connected to the upper end of the lower portion 34 of the third stile. By way of typical and therefore non-limative example, member 34 may be constructed from tubular material and member 40 may be sized to be snuggly receivable within the tubular upper end portion of member 34. End member 40 includes a radial flange 42 which is an integral part of member 40 and which rests on the upper end of member 34. Flange 42 carries the weight that is placed on member 40 and 34 by the user and transfers such weight to the upper end of member 34.

Connector means 38 also comprises a second end piece 44 which is telescopically received within the tubular upper portion 32 of the third stile. As previously mentioned, end piece 40 is snuggly received within the tubular end portion of member 34. It is bonded, rivoted, heat shrunk, or otherwise firmly connected to the end portion of member 34. In contrast, end member 44 is sized to be snuggly but slideably received within the upper portion 32 of the third stile.

A longitudinal slot 46 is provided in the side wall of member 32. A pin member, shown in the form of a bolt 48, extends through the slot 36 and threads into a threaded opening provided in an upper end portion of end piece 44. The shank of pin 48 is narrower than the slot 47, but the head portion of pin 48 is wider than the slot 47.

As shown by FIG. 3, the pin 48 makes contact with the lower closed end of slot 47 and this arrangement stops or limits the outward telescopic movement of end piece 44. The engagement of pin 48 with slot 47 also prevents relative rotation between members 32 and 44.

As shown, member 44 has a cup-like upper portion which provides an upwardly opening socket 46. Socket 46 houses a leaf spring 50, the bight portion of which faces downwardly of the crutch or inwardly of the socket 46. The end portion 52 of one leg of spring 50 is bent so that it extends generally laterally of member 32. End member 52 extends into a socket provided in a button 54. The main body of button 54 is aligned with a side wall opening 56 provided in member 44. Button 54 includes a flange 58 which is sized larger than the opening 48, so that the button cannot be moved entirely through the opening 56. The body portion of button 54 is smaller than the opening 56 so that it can pass through the opening 56.

Member 32 is also provided with a side wall opening 60, located near the upper end of member 32.

As shown by FIG. 5 of the drawing, when the crutch is in its use position the body of button 54 extends through both of openings 56, 60. The leaf spring 50 holds it in such openings 56, 60 and the flange 58 prevents spring 50 from urging it entirely through the openings 56, 60. As can be appreciated, as long as the body portion of button 54 is located within both openings 56, 60, member 44 is locked in position relative to member 32, and such members cannot be moved telescopically.

Figures 6, 7:
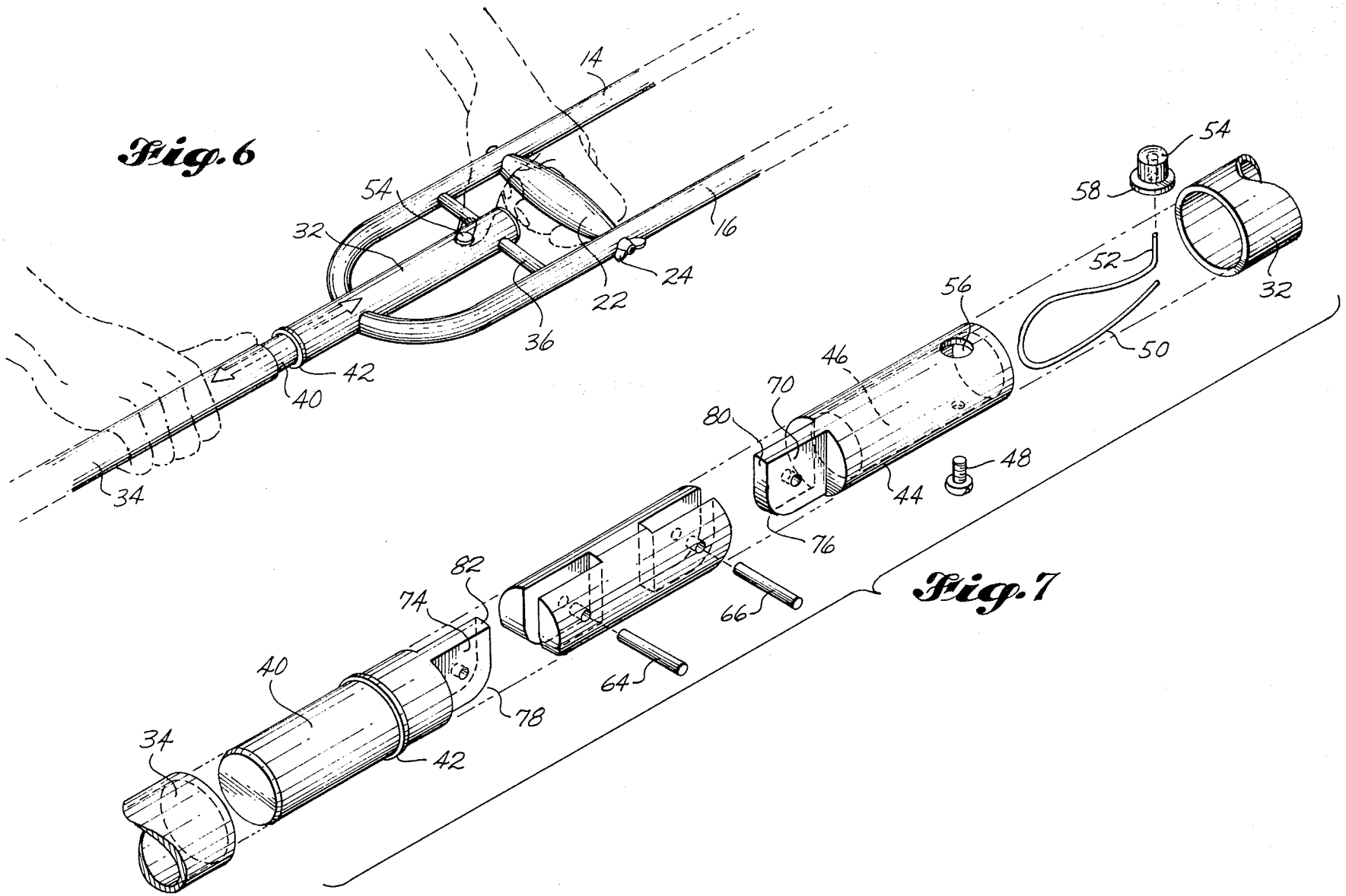
FIG. 6 is a fragmentary isometric view of a mid-portion of the crutch, showing the hand of a user in the process of unlocking the sections and starting the folding operations.
FIG. 7 is an exploded isometric view of the components of the connector means.

Connector means 38 also includes a link 62, a first pivot pit 64 which pivotally connects the upper end 68 of link 62 with the lower end 70 of member 44 and a second pivot pin 66 which pivotally connects the lower end 72 of link 62 with the upper end of 74 of end piece 40. As best shown by FIG. 7, end portion 68, 72 of link 62 may be slotted and the end portions 70, 74 of members 44, 40 may be configured to fit within the slots, so as to form "knuckle" type joints. End members 70, 74 may be termed "tongues". As shown by FIG. 7, tongues 70, 74 may be generally square ended but including one round corner 76, 78, enabling end pieces 44, 40 to be pivotally moved or swung in one direction only. The square corners 80, 82 provided opposite the rounded corners 78, 80 make contact with the flat bottom surfaces of the slots to prevent folding movement in the opposite direction. This feature is included to facilitate alignment of the end members 40, 44 with the link 62 when it is desired to unfold the crutch and telescopically move end piece 44, link 62 and the upper portion of end piece 40 into the interior of tubular member 32 (FIG. 5).

According to one aspect of the invention, the handle 22 is located in close enough proximatity to the button 54 that a user can grasp the handle 22 with one hand and the thumb of such hand will be positionable on the button 54 (FIG. 6). This arrangement enables the user to grasp the handle 22 with one of his hands (e.g. his left hand) while grasping the second section 12 with his other hand. Then, he only has to push down on button 54 by use of the thumb on his hand which is on the handle 22 and pull the two sections apart, to move the connector components from the confines of tubular member 32. Once the link 62 and end member 70, 74 are exposed, the crutch can be folded into the configuration shown by FIGS. 1 and 3.

In preferred form the folding crutch of this invention is constructed from light weight aluminum or light weight metal alloy tubing. The members 40, 44, 62 can be manufactured from a strong structural plastic, such as nylon, or can be constructed from a suitable metal material.

What is claimed is:

1. A folding crutch, comprising:

an upper section including an underarm rest, a handle below said underarm rest, and a tubular upper portion of a stile below said handle;

a lower section comprising a lower portion of said stile; and connector means connecting said upper and lower sections together in a manner permitting said sections to be moved between a use position in which the upper and lower sections are generally aligned and a folded position in which each section is adjacent the other section, said connector means comprising a first end piece connected to the upper end of the lower portion of said stile, a second end piece which is telescopically received within the tubular upper portion of the stile, a link positioned between said first and second end pieces; pivot pin means connecting the ends of said links to said end pieces in a manner permitting said end pieces, and the upper and lower sections of the crutch connected thereto, to be pivotally moved between a first position in which they are axially aligned with the link and a second position in which they are both substantially perpendicular to the link and adjacent one another, stop means for preventing telescopic movement of the second end piece completely out from the tubular upper portion of the stile, and releasable lock means carried by said second end piece and engageable with the tubular upper section of the stile for locking the two sections together in said use position, said lock means including a depressible lock button; and wherein the side wall opening in the upper portion of the stile is spaced longitudinally below said handle a distance which makes it possible for a user to grasp the handle with one hand and place his thumb on said lock button, so that he can with his other hand grasp the lower portion of the stile and pull his hands apart while depressing the lock button with his thumb, to release said releasable lock means and telescopically move the link out from the tubular portion of the stile, enabling the crutch to be folded.

2. A folding crutch according to claim 1, comprising a longitudinal slot in a side wall portion of the tubular upper portion of the stile, said slot having a closed lower end, and a pin means connected to the second end piece and extending radially outwardly through said slot, said pin and the closed end of said slot serving both as the stop means for preventing telescopic movement of the second end piece completely out from the tubular upper portion of the stile and as a guide means for guiding the lock button to the side wall hole in the upper portion of the third stile.

3. A folding crutch according to claim 1, wherein the upper end portion of the second end piece is hollow and includes a side wall and a first side wall opening therein, leaf spring means within its hollow interior, and a lock button which is in registery with said side wall opening and is biased radially upwardly by said spring, and wherein the tubular upper portion of the stile includes a second side wall opening which is in registery with said first side wall opening when the first and second sections of the folding crutch are in their use position, whereby the leaf spring means will urge the lock button radially outwardly so that it extends through both side wall openings and projects outwardly beyond the side boundary of the tubular upper portion of the stile, said lock button being depressable back into the hollow interior of the second end piece, to enable outward telescopic movement of such end piece when it is desired to fold the crutch.

4. A folding crutch according to claim 1, wherein said first end piece includes a body portion which is snuggly received with the upper end of the lower portion of the stile, and a radial flange which is an integral part of said first end piece and which abuts the upper end of the lower portion of the stile.

5. A folding crutch according to claim 3, comprising a longitudinal slot in a side wall portion of the tubular upper portion of the stile, said slot having a closed lower end, and a pin means connected to the second end piece and extending radially outwardly through said slot, said pin and the closed end of said slot serving both as the stop means for preventing telescopic movement of the second end piece completely out from the tubular upper portion of the stile and as a guide means for guiding the lock button to the side wall hole in the upper portion of the third stile.

6. A folding crutch according to claim 1, wherein the upper section of the crutch includes a pair of spaced apart stiles and the lower end portions of such stiles curve inwardly towards each other as they extend downwardly and are connected to a midportion of the tubular upper portion of the lower stile, and wherein the releasable lock means is located above such connection when the crutch is in its use position.

* * * * *